US006045461A

United States Patent [19]

Yamagishi et al.

[11] Patent Number: 6,045,461

[45] Date of Patent: Apr. 4, 2000

[54] TWO-PIECE SOLID GOLF BALL

[75] Inventors: Hisashi Yamagishi; Jun Shindo; Atsushi Nakamura, all of Chichibu, Japan

[73] Assignee: Bridgestone Sports Co., Ltd., Tokyo, Japan

[21] Appl. No.: 08/610,546

[22] Filed: Mar. 6, 1996

[30] Foreign Application Priority Data

Mar. 6, 1995 [JP] Japan ..... 7-072350

[51] Int. Cl.[7] ..... A63B 37/06; A63B 37/12

[52] U.S. Cl. ..... 473/377; 473/378; 473/351; 273/DIG. 20

[58] Field of Search ..... 473/377, 378, 473/351; 273/DIG. 20

[56] References Cited

U.S. PATENT DOCUMENTS 5,002,281 3/1991 Nakahara et al. ..... 273/220

5,368,304 11/1994 Sullivan et al. ..... 473/377

FOREIGN PATENT DOCUMENTS 2 276 093 9/1984 United Kingdom .

2 276 628 10/1994 United Kingdom .

*Primary Examiner*—George J. Marlo

*Attorney, Agent, or Firm*—Sughrue, Mion, Zinn, Macpeak & Seas, PLLC

[57] ABSTRACT

A two-piece solid golf ball comprising a solid core and a cover has a specific gravity of 1.0–1.1. The cover has a Shore D hardness of at least 60. The ball satisfies $1.10 \leqq A/B \leqq 1.60$ wherein A and B are distortions (mm) of the solid core and the ball under a load of 100 kg, respectively. The ball will follow an adequately high trajectory to ensure an increased flying distance when ordinary golfers with a head speed of about 40 m/sec. hit it with drivers and especially with long irons. The ball also offers a soft feel on hitting.

6 Claims, 1 Drawing Sheet

TWO-PIECE SOLID GOLF BALL

BACKGROUND OF THE INVENTION

1. Field of the Invention

This invention relates to two-piece solid golf balls suitable for ordinary golfers who swing at a head speed of about 40 m/sec., especially those golfers who are weak in long iron shots.

2. Prior Art

For golf balls, various proposals have been made for improving the flying distance and hitting feel. Most proposals made on two-piece solid golf balls are adjusted so as to exert optimum performance when hit at a head speed of about 45 m/sec. They are not necessarily best suited for ordinary golfers who swing at a head speed of about 40 m/sec. More particularly, such ordinary golfers are disappointed with flying distances shorter than expected when they hit balls with drivers, probably because the balls tend to follow a low trajectory. Also, the ball shot with a long iron often flies only a short distance since many ordinary golfers are weak in long iron shots.

SUMMARY OF THE INVENTION

An object of the present invention is to provide a novel and improved two-piece solid golf ball which is suitable for play by ordinary golfers with a head speed of about 40 m/sec. and which offers a satisfactory flying distance and a pleasant feel especially when shot with long irons.

The present invention provides a two-piece solid golf ball comprising a solid core and a cover enclosing the core. The ball has a specific gravity of 1.0 to 1.1. The cover has a Shore D hardness of at least 60. The ball satisfies A/B=1.10 to 1.60 where A and B are distortions (mm) of the solid core and the ball under a load of 100 kg, respectively. More specifically, by forming a golf ball to a lower specific gravity or lighter weight than conventional golf balls and controlling the ratio of the hardness or compression (A) of the solid core to the hardness or compression (B) of the solid core enclosed with the cover (finished golf ball) to fall in the above-defined range, there is obtained a ball which, when ordinary golfers with a head speed of 35 to 45 m/sec., especially, about 40 m/sec. hit it with drivers and long irons, will follow an adequate high trajectory rather than following a low trajectory or climbing up, covering an increased flying distance. In addition, the ball offers a pleasant feel on such shots.

The advantages of the invention are described in detail. It occurs very often that when ordinary golfers with a head speed of about 40 m/sec. hit golf balls with drivers and especially with long irons, the trajectory is low and the flying distance is far from satisfactory. It is generally known that the ball should be reduced in weight in order to provide a higher trajectory.

When a golf ball is hit into the air by a club, gravity (g), an aerodynamic lift (L) and an aerodynamic drag (D) act on the flying ball.

$$\text{Lift } L=\tfrac{1}{2}\rho V^2 S C_L \quad (1)$$

$$\text{Drag } D=\tfrac{1}{2}\rho V^2 S C_D \quad (2)$$

p: air density

V: ball velocity

S: ball cross-sectional area $C_L$: lift coefficient $C_D$: drag coefficient

An inertial force F acts on the ball which is expressed by:

$$\text{inertial force } F=mg+D+L \quad (3)$$

wherein the ball has a mass m. Kinetic equations of the golf ball flying through the air are expressed by the equations:

$$mx=-D\cos\theta-L\sin\theta \quad (4)$$

$$my=-mg-D\sin\theta+L\cos\theta \quad (5)$$

wherein θ is an in-flight angle of the ball relative to the ground or horizontal plane.

It is understood that as the mass of the ball is reduced, the inertial force is reduced as seen from equation (3), resulting in a reduced flying distance. On the other hand, the gravitational action on the ball is reduced as seen from equation (5), resulting in a higher trajectory.

The golf ball has the problem that reducing the ball weight will lead to a higher trajectory, but can induce a climbing phenomenon, resulting in a shorter flying distance. We have found that a golf ball having a lower specific gravity of 1.0 to 1.1 than the conventional value and including a cover having a Shore D hardness of at least 60 degrees with the ratio of the distortion of the core to the distortion of the ball falling in the specific range has improved flying performance in that it follows an adequately high trajectory to ensure an increased flying distance without following a low trajectory or climbing up when ordinary golfers with a head speed of about 40 m/sec. hit it with drivers and especially with long irons. The ball receives an adequate spin rate. The ball is improved in feel in that it offers a light and pleasant feel on hitting.

DETAILED DESCRIPTION OF THE INVENTION

Figure 1:
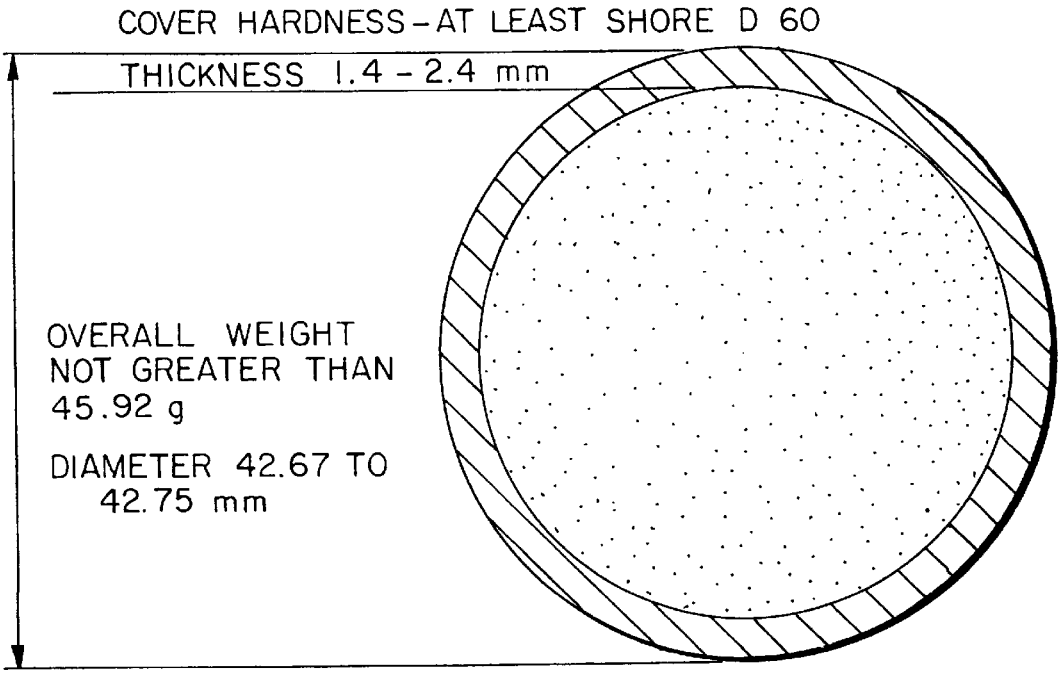
FIG. 1 is a cross sectional view of the golf ball in accordance with this invention.

The present invention provides a two-piece solid golf ball comprising a cover enclosing a solid core as illustrated in FIG. 1. The ball has a specific gravity of 1.0 to 1.1. The cover has a Shore D hardness of at least 60. A/B ranges from 1.10 to 1.60 wherein A and B are distortions (mm) of the solid core and the ball under a load of 100 kg, respectively.

The ball has a specific gravity of 1.0 to 1.1 as mentioned above, preferably from 1.02 to 1.09. A ball having a specific gravity of less than 1.0 is felt light or soft, is likely to receive wind resistance in flight so that its trajectory may be deflected, and additionally is too low in inertial force to cover a long flying distance. On the other hand, a ball having a specific gravity of more than 1.1 is not different from conventional golf balls or usual field-play golf balls, failing to attain the objects of the invention.

The ball should have a weight of not greater than 45.92 grams as prescribed in the Rules of Golf. For the objects of the invention, the ball preferably has a weight of 40 to 44 grams, especially 41.0 to 44.5 grams.

In the golf ball of the invention, the cover is formed to a Shore D hardness of at least 60. The cover hardness is not particularly limited insofar as it is 60 or more on the Shore D scale. Preferably the cover has a Shore D hardness of 62 to 68 with a permissible measurement error of ±3. If the cover hardness is less than 60 degrees in Shore D, the ball becomes less repulsive and receives a more spin and a larger launch angle upon hitting so that the ball may climb high and stall, failing to cover a long flying distance. An increased Shore D hardness means that the cover is too hard so that the golf ball may be less durable.

Preferably the cover is formed around the core to a radial thickness of 1.4 to 2.4 mm, especially 1.5 to 2.3 mm. A cover of less than 1.4 mm in thickness would be low in cut resistance so that the ball might be less durable. A cover of more than 2.4 mm in thickness would give a dull feel upon hitting and a ball with such a thick cover would become less repulsive.

The cover material is not critical and well-known cover materials are useful. Covers made of ionomer resins, especially lithium Surlyn and Surlyn mixtures containing the same are preferred for the objects of the invention.

According to the invention, a core/ball distortion ratio A/B ranges from 1.10 to 1.60, especially from 1.15 to 1.55 wherein A is a distortion (mm) of the solid core under a load of 100 kg and B is a distortion (mm) of the golf ball under a load of 100 kg. Within this range, the ball can fly an increased distance by preventing climb-up despite its light weight and afford a pleasant feel upon hitting. With A/B<1.10, hitting feel becomes inferior and the launch angle is small so that the ball may be difficult to hit high with long irons. With A/B>1.60, the launch angle is increased and the trajectory is high so that the ball will be affected by wind, failing to gain a flying distance. Hitting feel is also inferior.

Preferably, the core to be enclosed with the cover undergoes a distortion (A) of at least 4.2 mm, especially 4.2 to 4.7 mm under an applied load of 100 kg. With a core distortion of less than 4.2 mm, a ball after enclosure with a cover as defined above would give a hard feel upon hitting. With a core distortion of more than 4.7 mm, the resulting ball would be less repulsive and deteriorated in flying performance. In forming a core, the core should preferably be fully vulcanized to its center to impart restitution to the ball. A core whose interior or center remains unvulcanized is less desirable because the resulting ball becomes less repulsive, short in flying distance, and inferior in hitting feel and durability.

The core may be formed of a conventional solid core material by a conventional technique while properly adjusting vulcanizing conditions and formulation. Usually the core is formed of a composition comprising a base rubber, a crosslinking agent, a co-crosslinking agent, and an inert filler. The base rubber may be selected from natural rubber and synthetic rubbers used in conventional solid golf balls. The preferred base rubber is 1,4-polybutadiene having at least 40% of cis-structure. The polybutadiene may be blended with natural rubber, polyisoprene rubber, styrene-butadiene rubber or the like. The crosslinking agent is typically selected from organic peroxides such as dicumyl peroxide and di-t-butyl peroxide, especially dicumyl peroxide. About 0.5 to 3 parts by weight, preferably about 0.8 to 1.5 parts by weight of the crosslinking agent is blended with 100 parts by weight of the base rubber. The co-crosslinking agent is typically selected from metal salts of unsaturated fatty acids, inter alia, zinc and magnesium salts of unsaturated fatty acids having 3 to 8 carbon atoms (e.g., acrylic acid and methacrylic acid) though not limited thereto. Zinc acrylate is especially preferred. About 5 to 45 parts by weight, preferably about 10 to 40 parts by weight of the co-crosslinking agent is blended with 100 parts by weight of the base rubber. Examples of the inert filler include zinc oxide, barium sulfate, silica, calcium carbonate, and zinc carbonate, with zinc oxide being often used. The amount of the filler blended is preferably 0 to about 40 parts by weight per 100 parts by weight of the base rubber although the amount largely varies with the specific gravity of the core and cover, the weight of the ball, and other factors. In the practice of the invention, the amount of the filler is properly selected in a less loading range so as to provide the desired specific gravity and weight to the ball.

A core-forming composition is prepared by kneading the above-mentioned components in a conventional mixer such as a Banbury mixer and roll mill, and it is compression or injection molded in a core mold. The molding is then cured by heating at a sufficient temperature for the crosslinking agent and co-crosslinking agent to function (for example, a temperature of about 130 to 170° C. for a combination of dicumyl peroxide as the crosslinking agent and zinc acrylate as the co-crosslinking agent), obtaining a core. A cover composition is then molded over the core by an injection molding or compression molding technique in a conventional manner, obtaining a two-piece solid golf ball according to the invention.

As in the case of conventional golf balls, the golf ball of the invention is formed with a multiplicity of dimples in the cover surface. Preferably the ball has about 300 to 550 dimples, more preferably about 360 to 450 dimples. The dimples may be arranged in any desired pattern as in conventional golf balls. There may be two or more types of dimples which are different in diameter and/or depth.

The golf ball of the invention is prepared in accordance with the Rules of Golf, that is, to a diameter of at least 42.67 mm, preferably 42.67 mm to 42.75 mm and a weight of not greater than 45.92 grams, preferably 40 to 44 grams. The inventive golf ball has a low specific gravity as specified above while such a low specific gravity is preferably achieved by using a solid core having a low specific gravity or light weight.

EXAMPLE

Examples of the present invention are given below by way of illustration and not by way of limitation. All parts are by weight.

Examples 1–4 & Comparative Examples 1–2

Solid cores as shown in Table 1 were prepared by blending the following components.

| Core components | Parts |
|---|---|
| Cis-1,4-polybutadiene rubber (BR01) | 100 |
| Zinc acrylate | 18–35 |
| Zinc oxide | 2–25 |
| Antioxidant | 0.2 |
| Dicumyl peroxide | 0.9 |

Each compound was molded into a core in a mold and heated at 155° C. for about 20 minutes for thoroughly vulcanizing the core. Hardness was adjusted by changing the amounts of zinc acrylate and zinc oxide. Also barium sulfate was used as a gravity adjuster so that the resultant golf balls had the weight shown in Table 1. The cores were measured for distortion (mm) under an applied load of 100 kg, which is designated core distortion A.

A cover material was prepared by blending ionomer resins: Himilan 1605, Himilan 1706, and Himilan 1557 in a weight ratio of 50/25/25. The cover material was injection molded over the solid cores to produce two-piece solid golf balls as shown in Table 1. The balls were measured for distortion (mm) under an applied load of 100 kg, which is designated ball distortion B.

The two-piece golf balls had an octahedral arrangement of dimples of types I and II as shown below.

| Dimple | Type I | Type II |
|---|---|---|
| Diameter, mm | 3.75 | 3.50 |
| Depth, mm | 0.200 | 0.200 |
| $V_0$ | 0.480 | 0.480 |
| Number | 144 | 216 |

It is noted that provided that each dimple has a circular edge, the dimple space below a circular plane circumscribed by the dimple edge has a volume (Vp), a cylinder whose bottom is the circular plane and whose height is the maximum depth of the dimple from the bottom has a volume (Vq), and $V_0$ is the dimple space volume (Vp) divided by the cylinder volume (Vq).

Using a swing robot manufactured by True Temper Co., the golf balls were hit by a driver and #3 iron at a head speed (HS) of 40 m/sec. for determining spin, launch angle, carry, total, and in-flight angle. The driver had a loft angle of 12.50 and the #3 iron had a loft angle of 22°. Using a panel of three male senior golfers, the balls were evaluated for hitting feel according to the following rating.

O: light and soft

Δ: fairly hard

X: too light, too soft, unreliable

TABLE 1

| | Example | | | | Comparative Example | |
|---|---|---|---|---|---|---|
| | 1 | 2 | 3 | 4 | 1 | 2 |
| Core | | | | | | |
| Distortion A (mm) | 4.50 | 4.35 | 4.60 | 4.22 | 3.50 | 2.20 |
| Cover | | | | | | |
| Thickness (mm) | 2.0 | 2.3 | 2.0 | 1.4 | 1.9 | 1.9 |
| Shore D hardness | 63 | 63 | 63 | 63 | 63 | 63 |
| Ball | | | | | | |
| Outer diameter (mm) | 42.70 | 42.70 | 42.70 | 42.70 | 42.70 | 42.70 |
| Weight (g) | 41.50 | 42.75 | 44.20 | 43.00 | 45.30 | 44.00 |
| Distortion B (mm) | 3.75 | 2.90 | 3.68 | 3.45 | 3.33 | 1.05 |
| Specific gravity | 1.02 | 1.05 | 1.09 | 1.05 | 1.11 | 1.08 |
| Core/ball | | | | | | |
| compression ratio (A/B) | 1.20 | 1.50 | 1.25 | 1.22 | 1.05 | 2.10 |
| #1 wood | | | | | | |
| Spin (rpm) | 2670 | 2720 | 2600 | 2780 | 2830 | 2910 |
| Launch-angle (°) | 10.1 | 10.0 | 10.2 | 9.9 | 9.7 | 9.5 |
| Carry (m) | 195.0 | 194.8 | 194.0 | 194.0 | 193.5 | 192.5 |
| Total (m) | 210.0 | 211.0 | 211.5 | 211.3 | 210.0 | 205.7 |
| Angle (°) | 12.6 | 12.4 | 12.5 | 12.3 | 12.3 | 12.1 |
| Feel | ○ | ○ | ○ | ○ | Δ or X | X |
| #3 iron | | | | | | |
| Spin (rpm) | 3614 | 3672 | 3510 | 3753 | 3815 | 4015 |
| Launch angle (°) | 11.8 | 11.6 | 11.9 | 11.5 | 11.3 | 11.1 |
| Carry (m) | 148.0 | 147.5 | 147.0 | 148.3 | 145.0 | 140.3 |
| Total (m) | 151.0 | 151.8 | 152.0 | 150.8 | 148.5 | 144.7 |
| Angle (°) | 13.5 | 13.1 | 13.3 | 13.0 | 12.9 | 12.5 |
| Feel | ○ | ○ | ○ | ○ | Δ or X | X |

There has been described a golf ball having a specific gravity, cover hardness, and core/ball compression ratio in the above-defined ranges. The ball has improved flying performance in that it follows an adequately high trajectory to ensure an increased flying distance without following a low trajectory or climbing up when ordinary golfers with a head speed of about 40 m/sec. hit it with drivers and especially with long irons. The ball is also improved in feel in that it offers a soft feel on hitting.

Although some preferred embodiments have been described, many modifications and variations may be made thereto in the light of the above teachings. It is therefore to be understood that within the scope of the appended claims, the invention may be practiced otherwise than as specifically described.

We claim:

1. A two-piece solid golf ball comprising a solid core and a cover enclosing the core, wherein said ball has a specific gravity in the range of 1.0 to 1.1, a diameter in the range of 42.67 to 42.75 mm and a weight in the range of 40 to 44 grams, said cover has a Shore D hardness of at least 60, said solid core has a distortion in the range of 4.2 to 4.7 mm under a load of 100 kg, and A/B ranges from 1.10 to 1.60 wherein A and B are distortions (mm) of the solid core and the ball under a load of 100 kg, respectively.

2. A two-piece solid golf ball according to claim 1 wherein the ratio of A/B is within the range of 1.15 to 1.55.

3. A two-piece solid golf ball according to claim 1 wherein said golf ball has a specific gravity in the range of 1.02 to 1.09.

4. A two-piece solid golf ball according to claim 1 wherein said cover has a Shore D hardness in the range of 62 to 68.

5. A two-piece solid golf ball according to claim 1 wherein said cover has a radial thickness in the range of 1.4 to 2.4 mm.

6. A two-piece solid golf ball according to claim 1 wherein said cover has a radial thickness in the range of 1.5 to 2.3 mm.

* * * * *